US008636601B2

(12) United States Patent
Zhang et al.

(10) Patent No.: US 8,636,601 B2
(45) Date of Patent: Jan. 28, 2014

(54) INFANT CARRIER APPARATUS

(75) Inventors: Shaoyue Zhang, Central Hong Kong (HK); Man Qun Cheng, Central Hong Kong (HK)

(73) Assignee: Wonderland Nurserygoods Company Limited, Hong Kong (HK)

( * ) Notice: Subject to any disclaimer, the term of this patent is extended or adjusted under 35 U.S.C. 154(b) by 238 days.

(21) Appl. No.: 13/212,876

(22) Filed: Aug. 18, 2011

(65) Prior Publication Data

US 2012/0046117 A1 Feb. 23, 2012

(30) Foreign Application Priority Data

Aug. 20, 2010 (CN) ..... 2010 2 0501356 U

(51) Int. Cl.
*A63G 9/16* (2006.01)
*A63G 9/00* (2006.01)

(52) U.S. Cl.
USPC ..... 472/119; 5/109

(58) Field of Classification Search
USPC ..... 472/118–125; 297/273–284; 5/108, 109
See application file for complete search history.

(56) References Cited

U.S. PATENT DOCUMENTS

| | | | | |
|---|---|---|---|---|
| 6,027,409 | A * | 2/2000 | Favorito et al. | 472/118 |
| 6,702,685 | B2 | 3/2004 | Mahlstedt et al. | |
| 6,887,161 | B2 | 5/2005 | Mahlstedt et al. | |
| 6,932,709 | B1 * | 8/2005 | Gubitosi et al. | 472/118 |
| 7,258,618 | B2 * | 8/2007 | Haut | 472/119 |
| 7,824,273 | B2 * | 11/2010 | Clapper et al. | 472/95 |
| 8,057,318 | B2 * | 11/2011 | Chen | 472/119 |
| 2001/0028184 | A1 | 10/2001 | Sitarski et al. | |
| 2006/0211506 | A1 | 9/2006 | Kakuda | |
| 2007/0018490 | A1 | 1/2007 | Jones | |
| 2009/0181780 | A1 | 7/2009 | Myers et al. | |

* cited by examiner

*Primary Examiner* — Kien Nguyen
(74) *Attorney, Agent, or Firm* — David I. Roche; Baker & McKenzie LLP

(57) ABSTRACT

An infant carrier apparatus includes a support frame having a generally L-shape, a swing arm and a seat assembly. The swing arm includes an upper segment, a lower segment parallel to the upper segment, and an upright segment connected between the upper segment and the lower segment, wherein the upper segment is pivotally connected with an upper end of the support frame. The seat assembly is disposed in a region between the upper segment and the lower segment, and is connected with the lower segment of the swing arm. The infant carrier apparatus can also include an adjustment mechanism that allows to conveniently adjust the height of the seat assembly.

23 Claims, 16 Drawing Sheets

INFANT CARRIER APPARATUS

CROSS-REFERENCE TO RELATED APPLICATION

This application claims priority to Chinese Patent Application No. 201020501356.0 filed on Aug. 20, 2010.

BACKGROUND OF THE INVENTION

1. Field of the Invention

The present invention relates to infant carrier apparatuses, and more particularly to an infant carrier apparatus that is adjustable in height.

2. Description of the Related Art

It is well known that regular and gentle swing motion can be helpful to comfort a young child. Accordingly, many infant carrier apparatuses are proposed to provide such functionality, such as swing apparatuses, child rocking chairs, cradles, and the like.

The construction of a swing apparatus usually includes a support frame, a seat, and a swing arm connecting the seat with the support frame. While the construction of the conventional swing apparatus allows to adjust the inclination of the seat relative to the support frame, the height of the support frame or the seat usually cannot be adjusted relative to the ground. Accordingly, the conventional swing apparatus has only one size in use.

Moreover, the length of the support frame usually remains unchanged after the swing apparatus is collapsed, which cannot effectively reduce the packaging material during shipment. Because the collapsed swing apparatus still has a relatively large size, the portability of the swing apparatus is not improved. As a result, the swing apparatus is mostly used in a fixed position.

Therefore, there is a need for an improved infant carrier apparatus that allows height adjustment in use, is convenient to transport and address at least the foregoing issues.

SUMMARY

The present application describes an infant carrier apparatus that permits convenient height adjustment. According to one embodiment, the infant carrier apparatus includes a support frame having a generally L-shape, a swing arm and a seat assembly. The swing arm includes an upper segment, a lower segment parallel to the upper segment, and an upright segment connected between the upper segment and the lower segment, wherein the upper segment is pivotally connected with an upper end of the support frame. The seat assembly is disposed in a region between the upper segment and the lower segment, and is connected with the lower segment of the swing arm. The infant carrier apparatus can also include an adjustment mechanism that allows to conveniently adjust the height of the seat assembly.

DETAILED DESCRIPTION OF THE EMBODIMENTS

Figure 1:
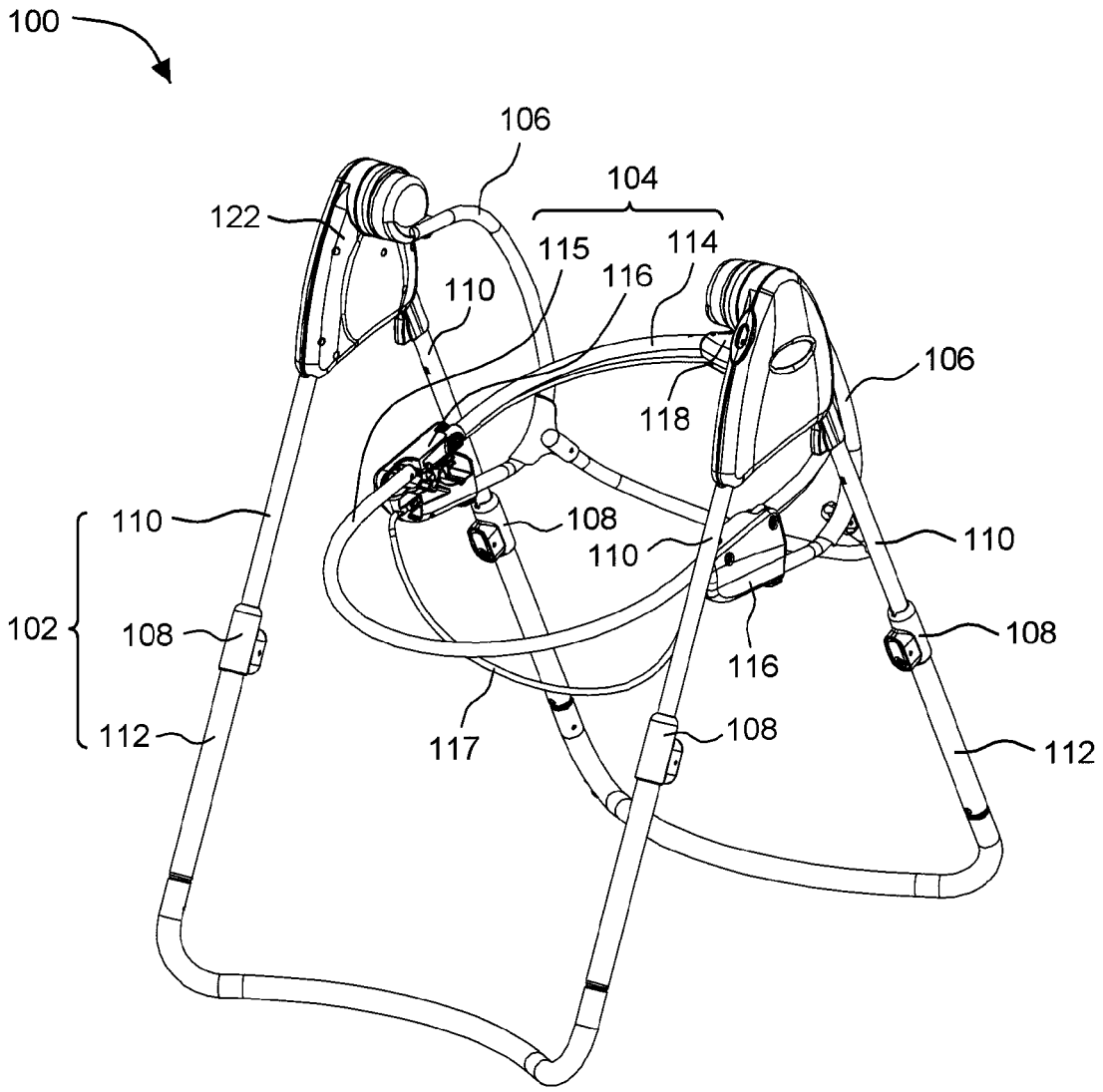
FIG. 1 is a schematic view illustrating a first embodiment of an infant carrier apparatus.
Figure 2:
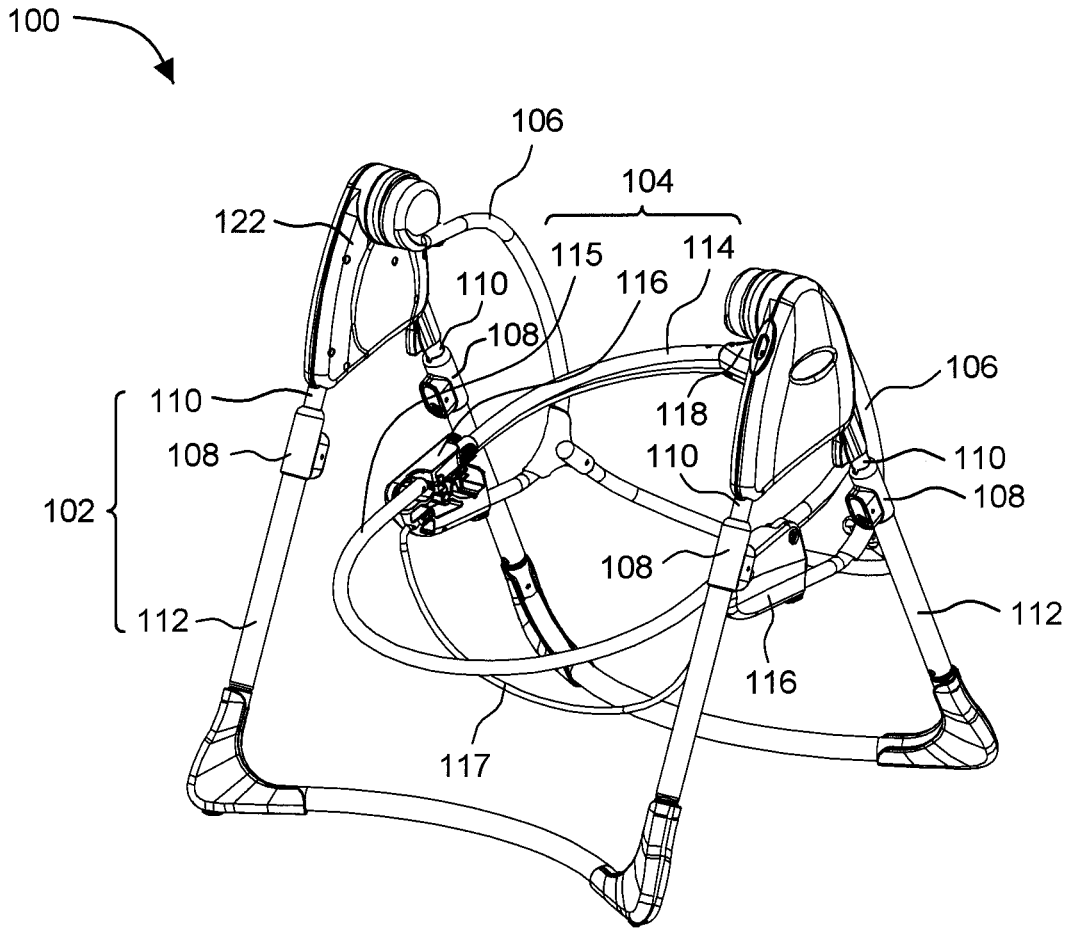
FIG. 2 is a schematic view illustrating exemplary height adjustment of the infant carrier apparatus.

FIG. 1 is a schematic view illustrating one embodiment of an infant carrier apparatus 100, and FIG. 2 is a schematic view illustrating exemplary height adjustment of the infant carrier apparatus 100. In this embodiment, the infant carrier apparatus 100 exemplary is a swing apparatus. However, the features described herein can be applied to other types of infant carrier apparatuses, such as infant seats and strollers. As shown in FIGS. 1 and 2, the infant carrier apparatus 100 can include a support frame 102, a seat assembly 104, and swing arms 106. The support frame 102 can include a plurality of first frame portions 110 and second frame portions 112, which may be respectively from tube assemblies. Each of the second frame portion 112 can have a generally U-shape having two side segments, and a transverse segment connected between the two side segments. Each first frame portion 110 can be respectively assembled with one side segment of one second frame portion 112 via a height adjustment mechanism 108, which is operable to modify the overall height of the support frame 102 and the height of the seat assembly 104 relative to the ground. The seat assembly 104 can be mounted with the support frame via the swing arms 106.

Figure 3:
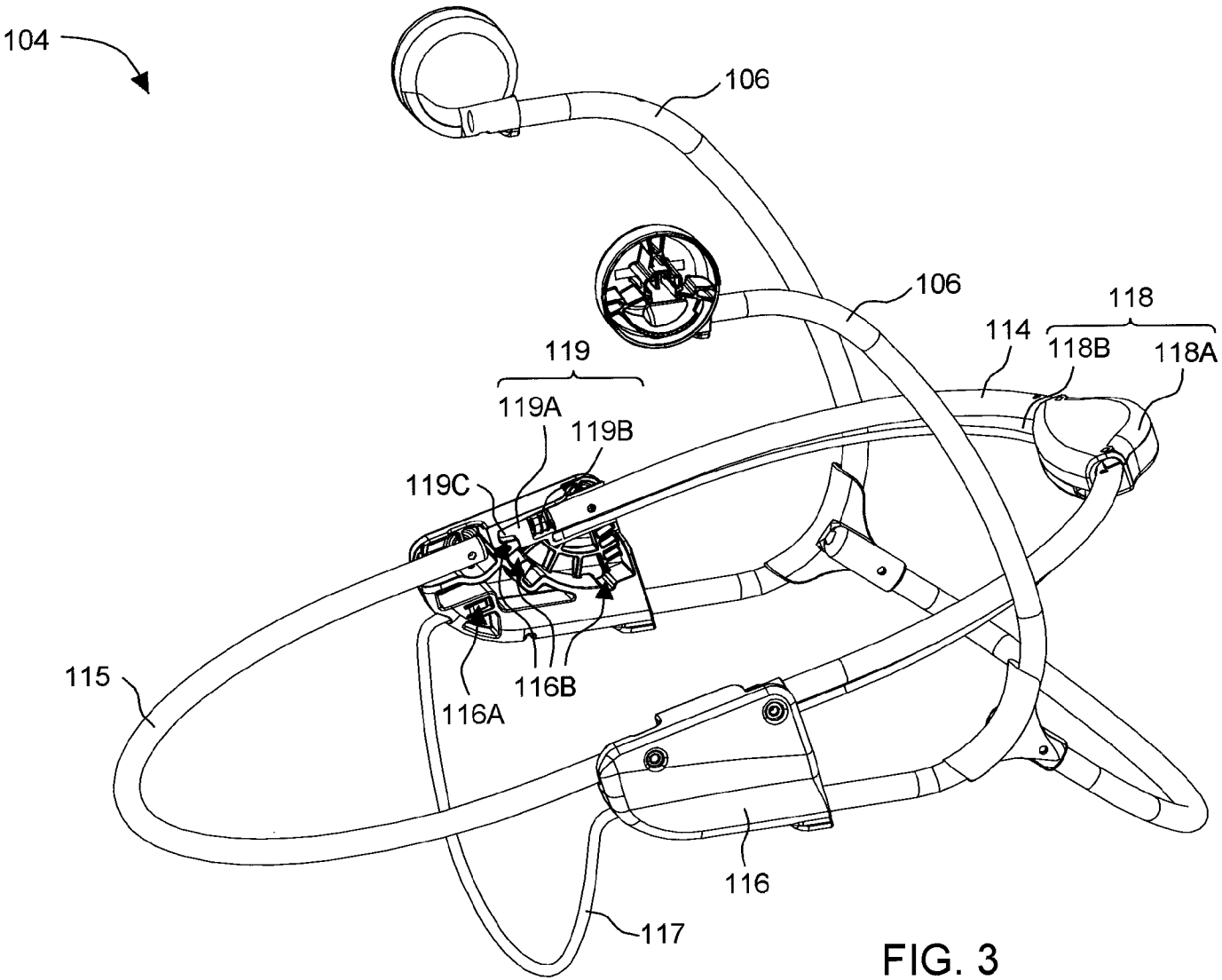
FIG. 3 is a schematic view illustrating the seat assembly of the infant carrier apparatus.
Figure 4:
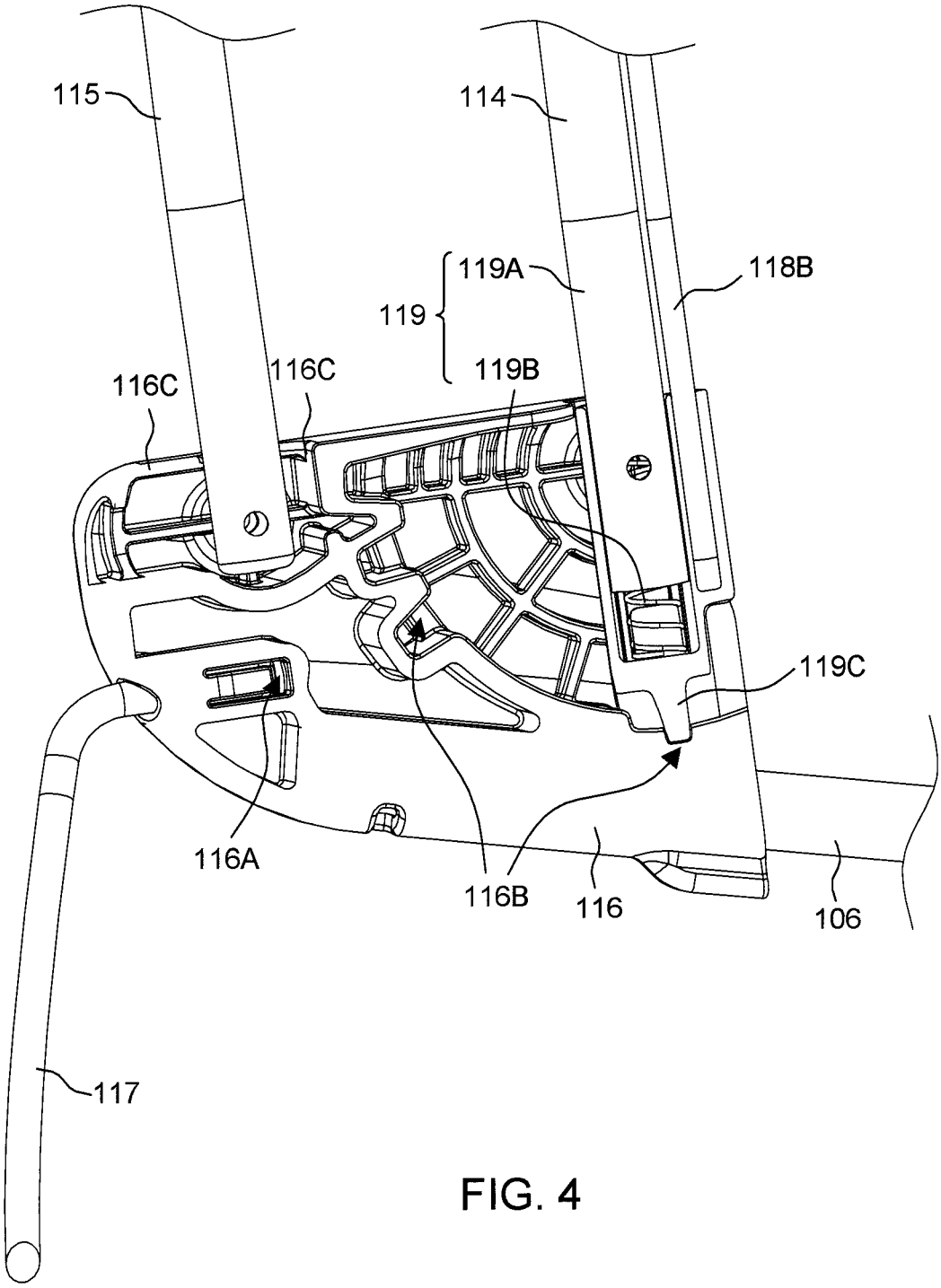
FIG. 4 is a schematic view illustrating the seat assembly in a collapsed state.

FIG. 3 is a schematic view illustrating the seat assembly 104 in more details, and FIG. 4 is a schematic view illustrating the seat assembly 104 in a collapsed state. Referring to FIGS. 1 through 4, the seat assembly 104 can include a rear tube element 114 and a front tube element 115 respectively having generally U-shapes, two seat coupling elements 116, a fixed frame 117 having a generally U-shape, and a release mechanism 118. Each of the rear tube element 114 and the front tube element 115 can have two (i.e., left and right) side segments pivotally connected with two seat coupling elements 116, respectively. Each of the seat coupling elements 116 can have a slot 116A into which a side segment of the fixed frame 117 is received and fixedly secured. The fixed frame 117 can hold a seat cushion or fabric element to allow a child to be lied down horizontally (not shown). Moreover, the swing arms 106 can also be affixed with the seat coupling elements 116.

The rear tube element 114 can have two side segments respectively provided with seat latching mechanisms 119. Each of the seat latching mechanisms 119 can include a tube segment 119A, and a spring 119B mounted through an interior of the tube segment 119A. Each side segment of the rear tube element 114 can be connected with the tube section 119A, so that an end of the spring 119B can be anchored therewith. The tube segment 119A can have a movable latch element 119C having an engagement tip protruding outward.

The release mechanism 118 can include an actuating portion 118A and two transmission elements 118B, which can be cable or like elongated elements. The actuating portion 118A can be adapted to drive a movement of the transmission element 118B. The actuating portion 118A can be assembled with the rear tube element 114, and each of the transmission elements 118B can have two distal ends respectively connected with the actuating portion 118A and one associated latch element 119C. Each seat coupling element 116 can define a plurality of lock grooves 116B disposed at different radial directions relative to a pivot axis of the rear tube element 114. The latch element 119C is adapted to engage with any of the lock grooves 116B to hold the rear tube element 114 in place. By operating the actuating portion 118A, the transmission element 118B can also be pulled to drive the latch element 119C in movement for disengaging from the lock groove 116B and compressing the spring 119B. Once the latch element 119C is disengaged from the lock grooves 116B, the rear tube element 114 can rotated relative to the seat coupling element 116 to adjust its angle of inclination. After the rear tube element 114 is adjusted to the desired angular position, the spring 119B can urge the latch element 119C to engage with a corresponding lock groove 116B to hold the rear tube element 114 in place.

As shown in FIG. 4, when the seat assembly 104 is to be collapsed, the release mechanism 118 can be first operated to disengage the latch element 119C from the lock groove 118B. Then, the front tube element 115 and the rear tube element 114 can be rotated in opposite directions (e.g., clockwise rotation for the front tube element 115 and anti-clockwise rotation for the rear tube element 114) until they lie at substantially parallel positions extending generally in a vertical direction. In this collapsed state, the seat coupling element 116 can be provided with a rib 116C that can act to restrict the rotation of the front tube element 115 for keeping the front tube element 115 in a generally vertical position. Moreover, the latch element 119C can engage with a corresponding loc groove 116B to keep the rear tube element 114 in the generally vertical position. Accordingly, the front tube element 115 and the rear tube element 114 can extend generally in a same direction as the swing arms 106 in the collapsed state, which can reduce the overall size of the infant carrier apparatus 100.

When the seat assembly 104 is to be deployed, the latch element 119C first can be disengaged from the lock groove 116B. Then the front tube element 115 and the rear tube element 114 can be reversely rotated in opposite directions. The front tube element 115 can thereby overcome the interference created by the rib 116C, and the rear tube element 114 can rotate rearward to respectively recover the deployed state shown in FIG. 3.

It is worth noting that the seat assembly and seat latching mechanisms are not limited to the construction described above. In alternate embodiments, a seat latching mechanism similar to the construction described previously can also be provided on the front tube element 115 to hold the front tube element 115 at the vertical position in the collapsed state.

Referring again to FIG. 1, each of the first frame portions 110 and each of the second frame portions 112 can be respectively formed by a tube or assembly of tubes. Each first frame portion 110 can have an upper end connected with a joining bracket 122, and a lower end movably inserted through a side segment of one second frame portion 112 to allow linear movement of the first frame portion 110 relative to the second frame portion 112. The height adjustment mechanism 108 can be actuated to release a locking engagement between the first frame portion 110 and the second frame portion 112, whereby the first frame portion 110 can be movable to adjust the length of the first frame portion 110 that lies in the side segment of the second frame portion 112.

Each of the swing arms 106 can have an upper end pivotally connected with one associated joining bracket 122, and a lower end connected with the seat coupling element 116.

Figure 5:
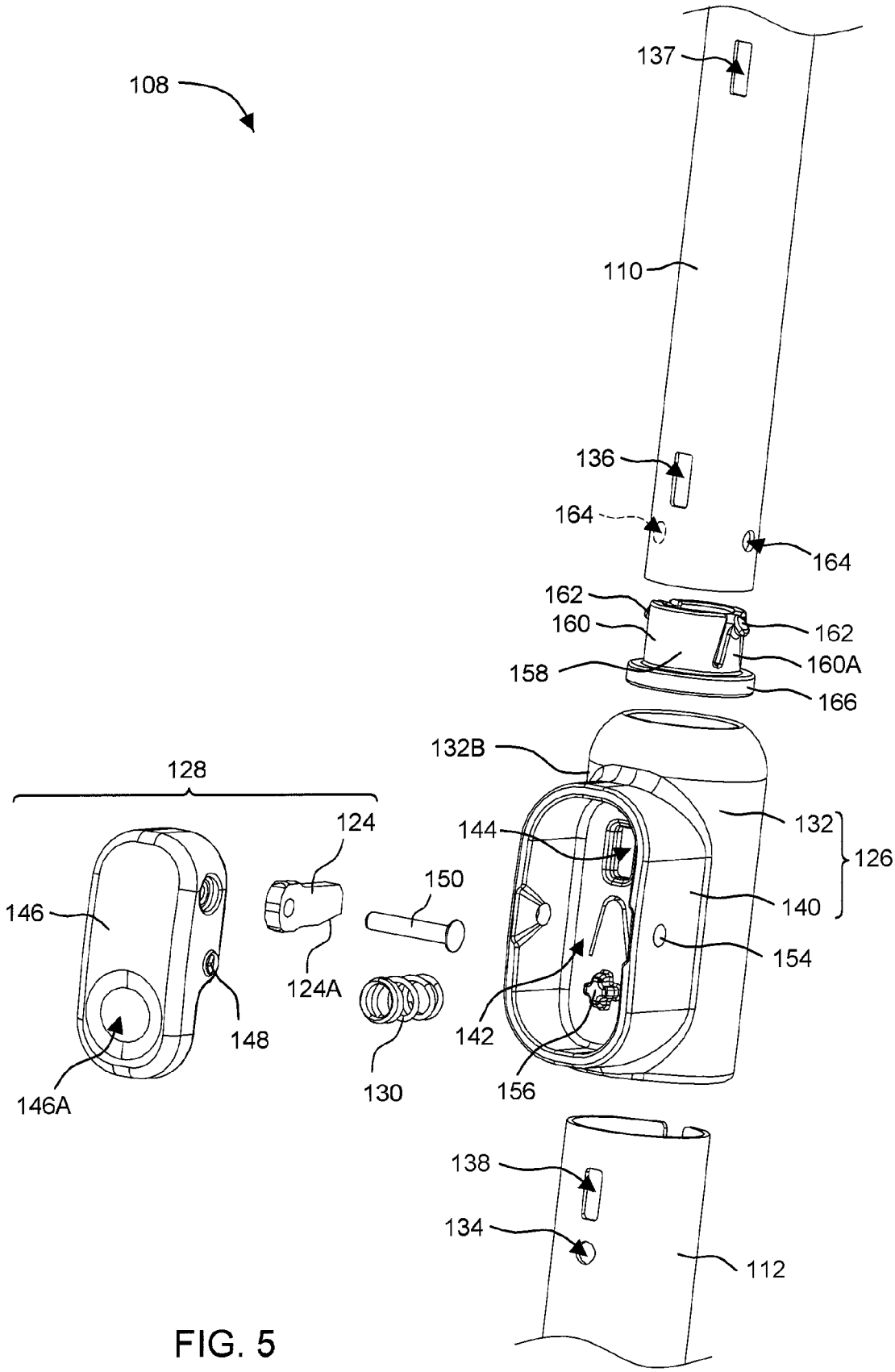
FIG. 5 is an exploded view illustrating a height adjustment mechanism provided in the infant carrier apparatus.
Figure 6:
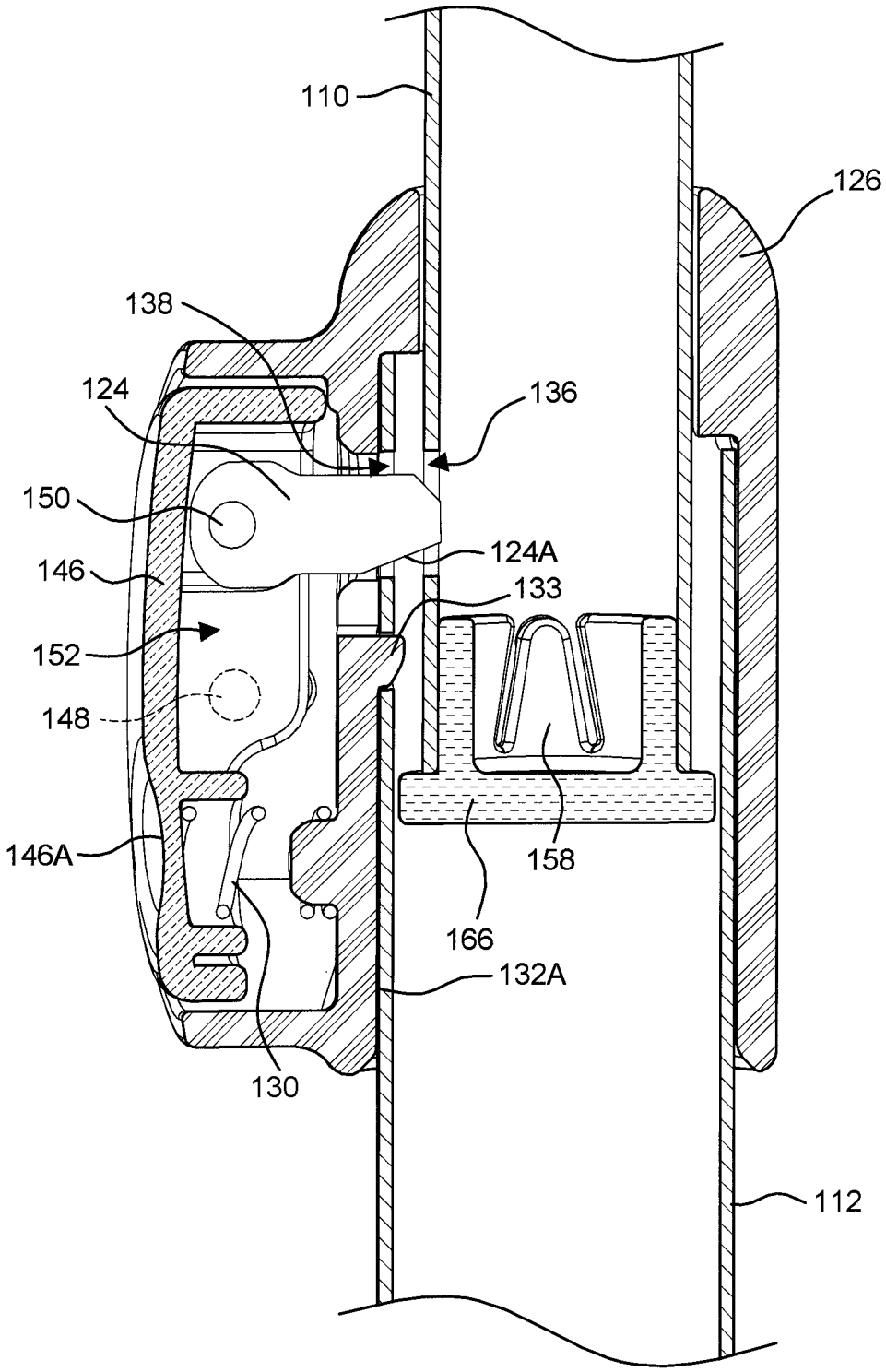
FIG. 6 is a schematic cross-sectional view of the height adjustment mechanism.

FIG. 5 is an exploded view illustrating one height adjustment mechanism 108, and FIG. 6 is a schematic cross-sectional view of the height adjustment mechanism 108. Referring to FIGS. 5 and 6, the height adjustment mechanism 108 can include a latch element 124, a housing 126, a release button 128 and a spring 130. The housing 126 can include a sleeve 132 having an inner sidewall 132A provided with a protrusion 133. The second frame portion 112 can have a hole 134 through which the protrusion 133 can be fixedly engaged to affix the housing 126 with an outer surface of the second frame portion 112. Moreover, the first frame portion 110 can also include a plurality of locking positions, e.g., first locking position 136 and second locking position 137. The first and second locking positions 136 and 137 can be formed as openings, holes, or like structures. The second frame portion 112 can include a hole 138 that is vertically positioned above the hole 134 of the second frame portion 112. The sleeve 132 can also have an outer sidewall 132B provided with a raised portion 140. The raised portion 140 can have a pocket 142 in which is received the release button 128. The housing 126 can further include an aperture 144 that can extend from an inner side of the pocket 142 to the inner sidewall 132A.

The release button 128 can include a button body 146, two pivot pins 148 symmetrically protruding outward from two sides of the button body 146, and a rivet 150. The button body 146 can include a cavity 152. The raised portion 140 can also include a pair of openings 154 to which the pivot pins 148 can be pivotally connected. An end portion of the latch element 124 can be affixed with an inner sidewall of the cavity 152 via the rivet 150 at a position vertically higher than the positions of the pivot pins 148. Moreover, the latch element 124 is mounted so as to pass through the aperture 144 of the housing 126. The spring 130 can have a first end connected with an anchor rib 156 provided in the pocket 142, and a second end connected with an inner sidewall of the cavity 152.

Referring again to FIGS. 5 and 6, the lower end of each first frame portion 110 can further include a plunger 158. The plunger 158 can include a generally cylindrical sleeve body 160 having an outer surface 160A provided with a pair of snap studs 162 protruding outward, and the first frame portion 110 can include a pair of corresponding catch holes 164. The sleeve body 160 can be inserted through the interior of the first frame portion 110, and the snap studs 162 can respectively engage with the catch holes 164 to affix the plunger 158 with the lower end of the first frame portion 110. Moreover, the outer surface 160A can also include an annular flange 166 protruding outward. The flange 166 can protrude outside the first frame portion 110, and is located inside the second frame portion 112.

As shown in FIG. 6, when the height adjustment mechanism 108 is in a locked state, the latch element 124 can pass through the hole 138 of the second frame portion 112 and engage with one locking position (e.g., the first locking position 136) of the first frame portion 110. The first frame portion 110 can be thereby locked with the second frame portion 112.

Figure 7:
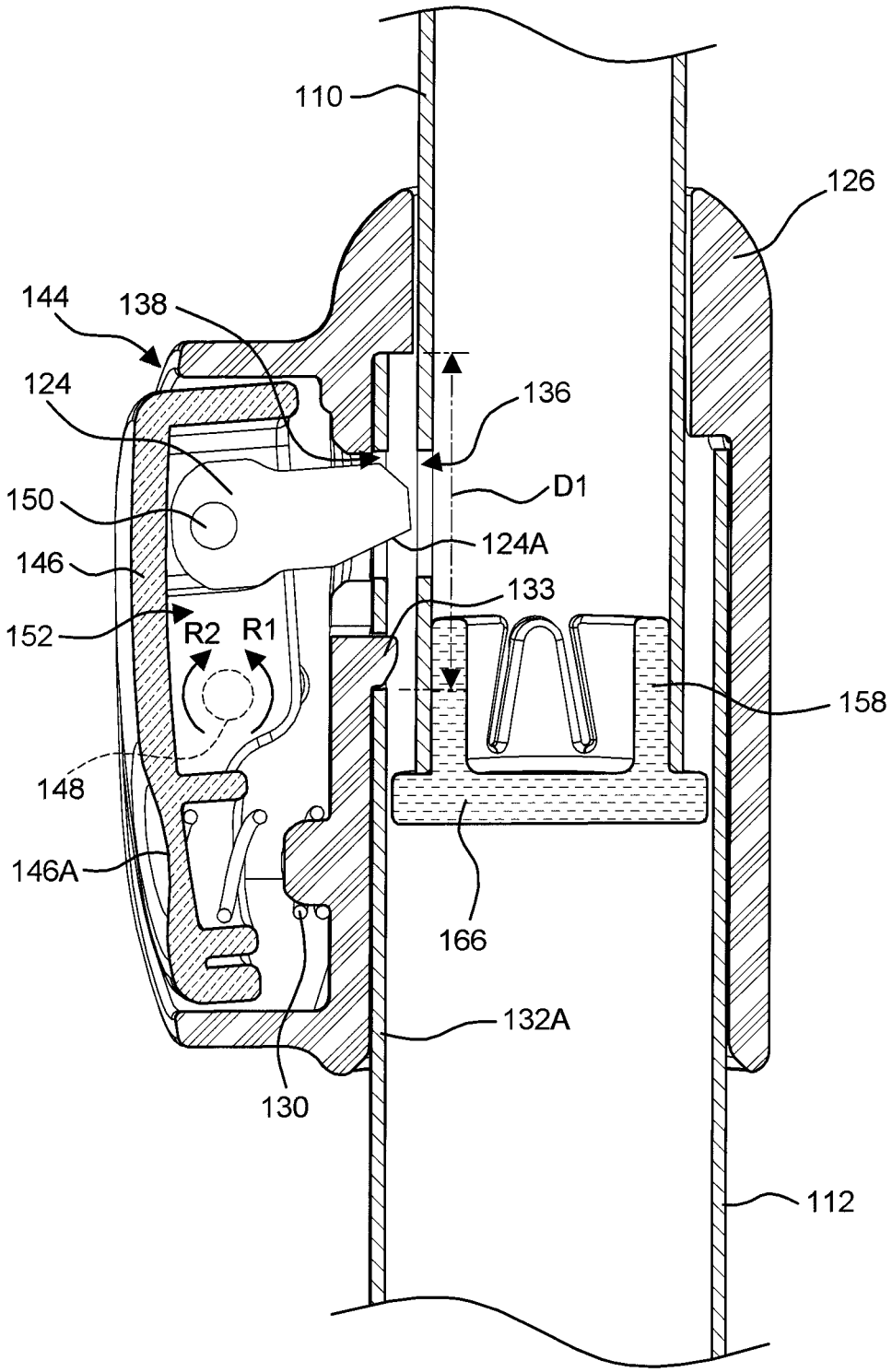
FIG. 7 is a schematic view illustrating the height adjustment mechanism in an unlocked state.

FIG. 7 is a schematic view illustrating the height adjustment mechanism 108 in an unlocked state. When the height adjustment mechanism 108 is to be switched from the locked state to the unlocked state, a pressure area 146A of the button body 146 can be depressed so as to drive the button body 146 to rotate in the direction R1 relative to the housing 126. As the button body 146 is rotating in the direction R1, the spring 130 is compressed, and the latch element 124 can be driven to disengage from the first locking position 136 of the first frame portion 110, which can remove the locking engagement between the first frame portion 110 and the second frame portion 112. The first frame portion 110 then can be driven to slide linearly relative to the second frame portion 112 to adjust the length of the first frame portion 110 lying in the second frame portion 112. The shortest length of the first frame portion 110 that can lie in the second frame portion 112 is D1. When the first frame portion 110 is adjusted to increase the length of the first frame portion 110 lying in the second frame portion 112, the overall height of the support frame 102 can be reduced to lower the seat assembly 104 relative to the ground.

It is worth noting that a lower edge of the latch element 124 facing the first locking position 136 of the first frame portion 110 can form an angled surface 124A. As the first frame portion 110 is moving upward, the first locking position 136 can have an edge that comes in contact with the angled surface 124A so as to push the latch element 124 toward the second frame portion 112. As a result, the latch element 124 can be disposed outside the first frame portion 110, and is passed only through the hole 138. Accordingly, the upward movement of the first frame portion 110 can automatically remove the locking engagement between the first frame portion 110 and the second frame portion 112, without the need of actuating the release button 128.

The height adjustment mechanism 108 can further include a structure adapted to prevent entire separation of the first frame portion 110 from the second frame portion 112. In other words, when the length of the first frame portion 110 lying in the second frame portion 112 reaches the predetermined length D1, the flange 166 of the plunger 158 can abut against the protrusion 133 of the housing 126 to block further upward movement of the first frame portion 110. The upward movement of the first frame portion 110 can be therefore limited to prevent complete separation of the first frame portion 110 from the second frame portion 112.

Figure 8:
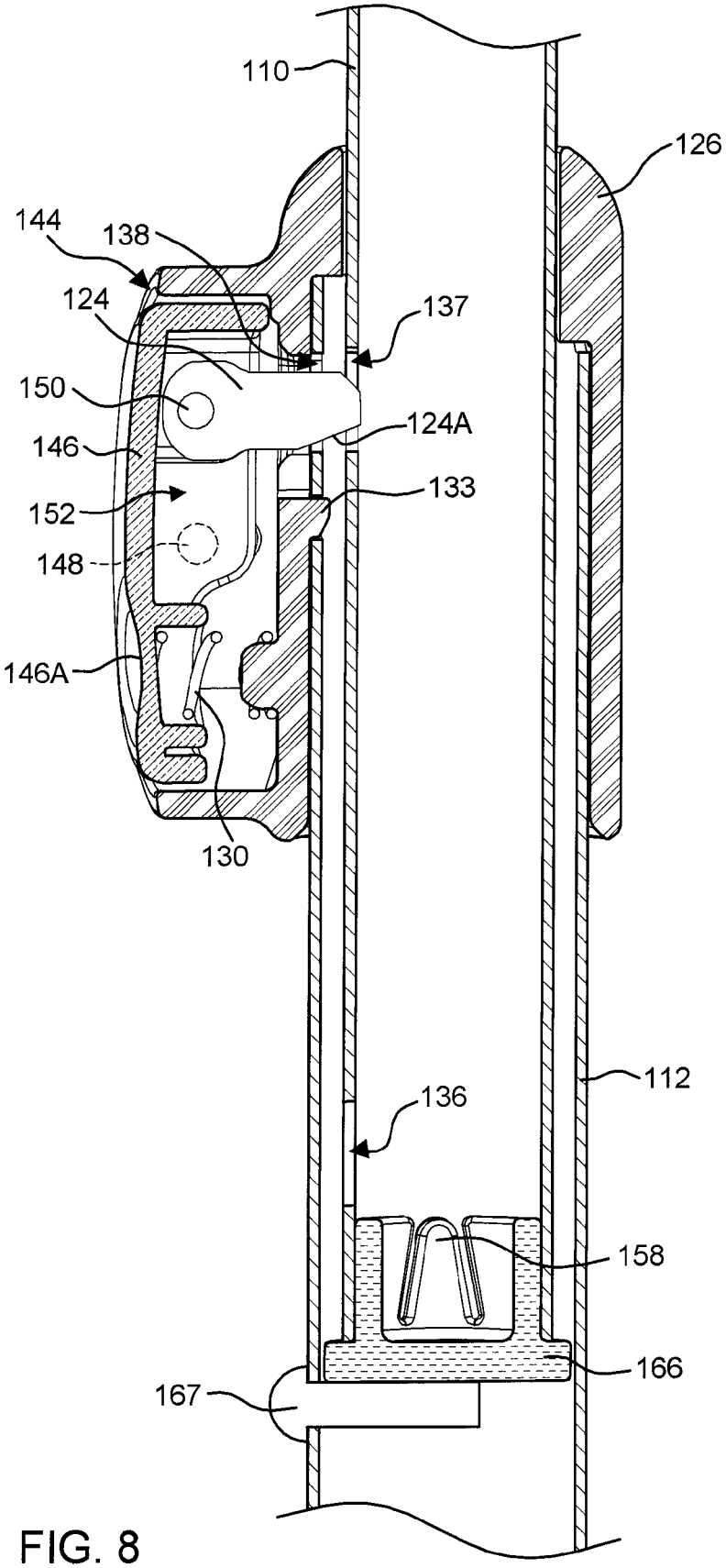
FIG. 8 is a schematic cross-sectional view illustrating the height adjustment mechanism after the support frame is reduced in height.

FIG. 8 is a schematic cross-sectional view illustrating the height adjustment mechanism 108 after the support frame 102 is reduced in height. Once the support frame 102 is adjusted to the desired height, the release button 128 can be released. As a result, the spring 130 can urge the button body 146 to rotate in the direction R2 so that the latch element 124 can engage with the second locking position 137 (e.g., a catch hole) of the first frame portion 110, whereby the first frame portion 110 can be locked with the second frame portion 112. In addition, the second frame portion 112 can also include a stop element 167 (e.g., rivet). When the first frame portion 110 is lowered a certain distance, the flange 166 can abut against the stop element 167 to block further downward movement of the first frame portion 110, whereby the movement of the first frame portion 110 can also be downwardly limited.

With the aforementioned construction, by actuating the release button 128 of the height adjustment mechanism 108, the overall height of the support frame 102 as well as the height of the seat assembly 104 relative to the ground can be easily adjusted. Accordingly, the infant carrier apparatus 100 can allow more flexible adjustment and improved portability.

Figure 9:
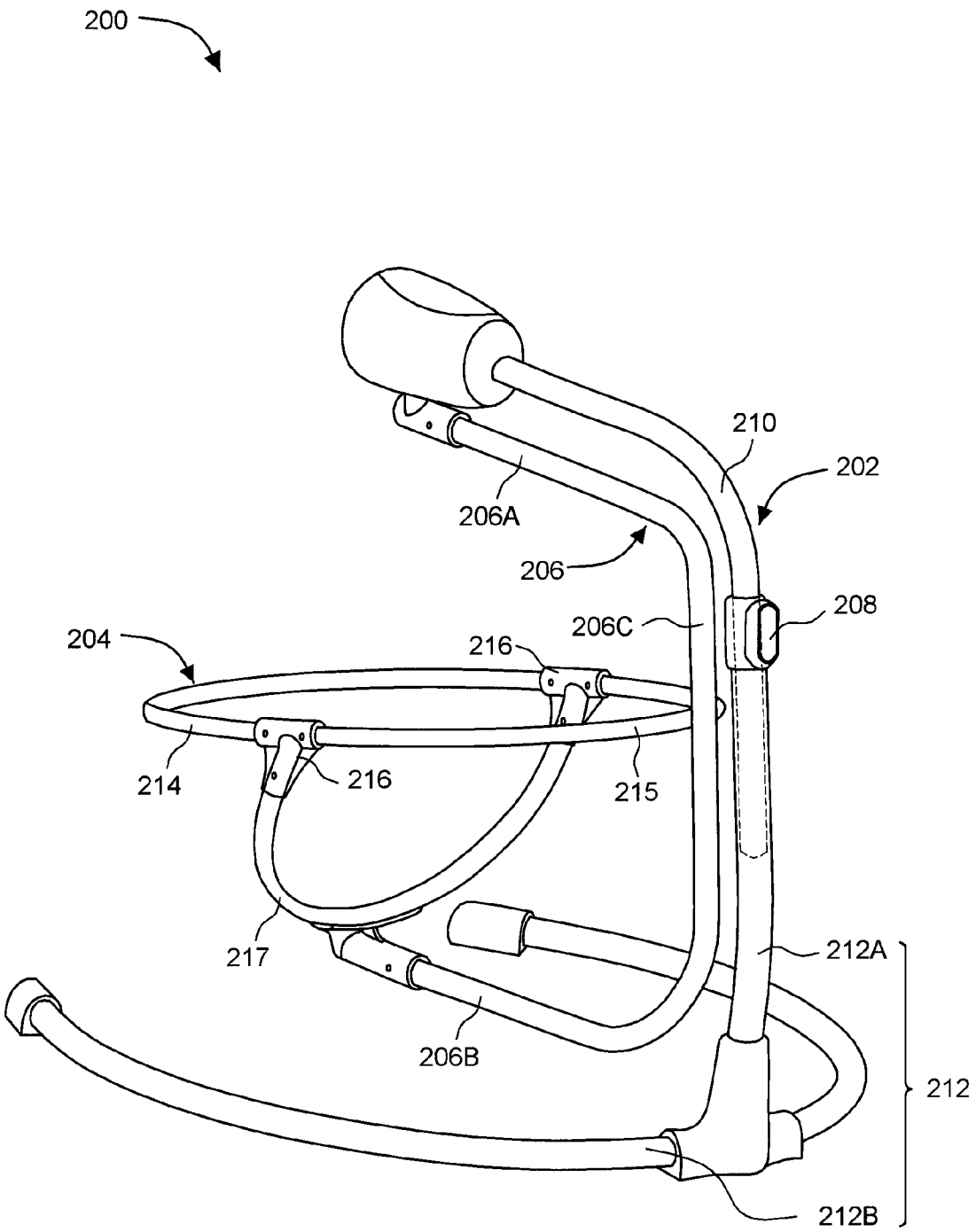
FIG. 9 is a schematic view illustrating a second embodiment of an infant carrier apparatus.
Figure 10:
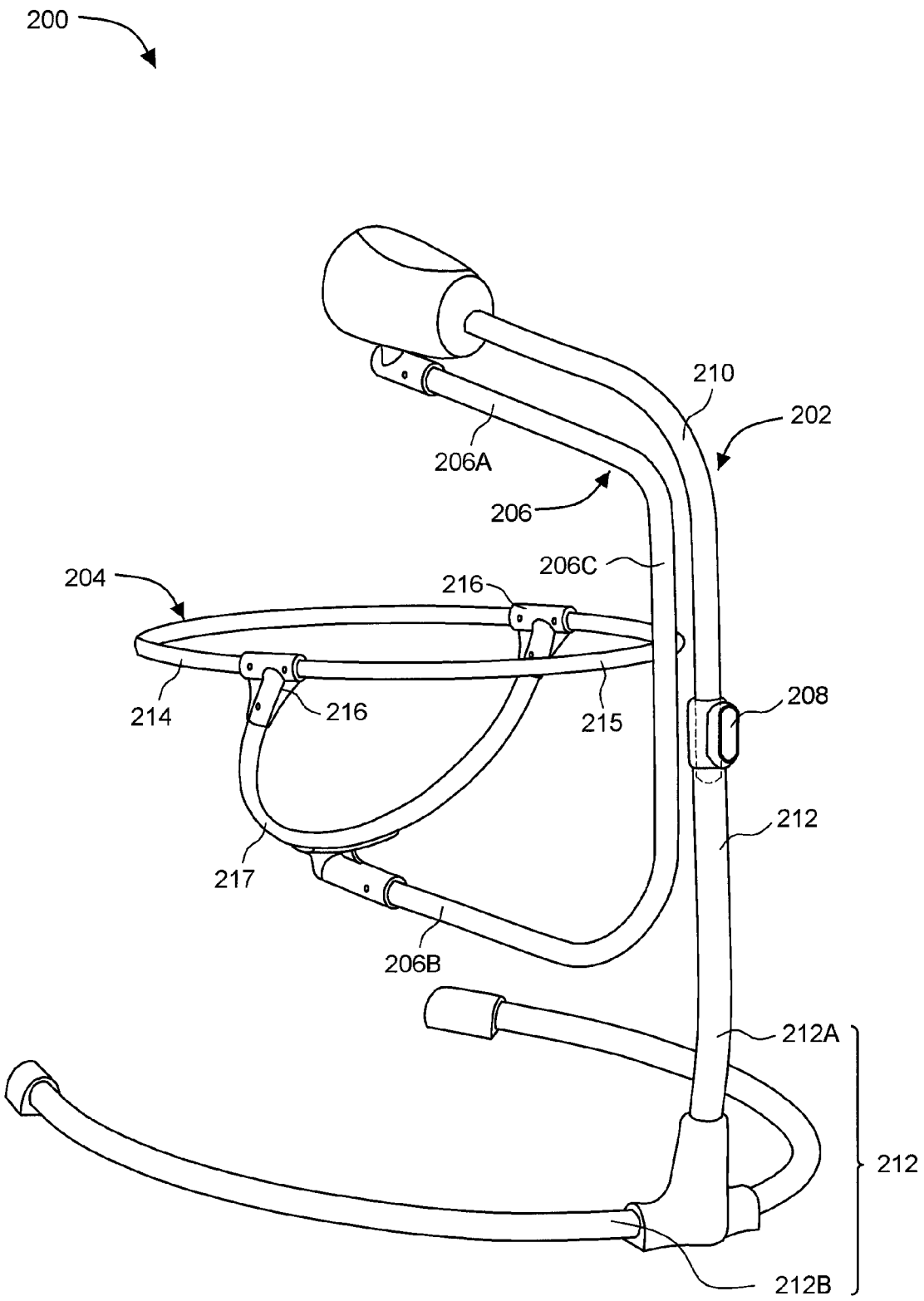
FIG. 10 is a schematic view illustrating a height adjustment provided in the second embodiment of the infant carrier apparatus.

FIG. 9 is a schematic view illustrating another infant carrier apparatus 200, and FIG. 10 is a schematic view illustrating a height adjustment of the infant carrier apparatus 200. Referring to FIGS. 9 and 10, the infant carrier apparatus 200 can include a support frame 202, a seat assembly 204 and a swing arm 206. The support frame 202 can include a first frame portion 210, and a second frame portion 212 connected with the first frame portion 210 via a height adjustment mechanism 208. By actuating the height adjustment mechanism 208, the overall height of the support frame 202 can be adjusted so as to modify the height of the seat assembly 204 relative to the ground (FIG. 9 shows the seat assembly 204 at a relatively lower position, and FIG. 10 shows the seat assembly 204 at a relatively higher position).

The first frame portion 210, the second frame portion 212 and the swing arm 206 have a design different from the previous embodiment. The first frame portion 210 can be formed as a bent tube having an upper end connected with the swing arm 206, and a lower end connected with the height adjustment mechanism 208. The second frame portion 212 can include an upright segment 212A, and a base 212B adapted to rest in contact with the ground. The base 212B can be formed as a generally U-shaped tubular element extending in a horizontal plane. The upright segment 212A can be formed as a generally vertical tube segment extending approximately perpendicular to the base 212B. The upright segment 212A can have a lower end connected with the base 212B, and an upper end connected with the height adjustment mechanism 208. Accordingly, the support frame 202 can have a generally L-shape having an upper end formed by an upper end of the first frame portion 210, a lower end formed by the base 212B of a relatively larger area, and a generally vertical tubular portion extending between the upper and lower ends. Moreover, the support frame 202 can define a space between the upper and lower ends where the swing arm 206 can be installed.

The swing arm 206 can be formed as a generally U-shaped tube assembly including upper and lower segments 206A and 206B generally parallel to each other, and an upright segment 206C connected between the upper and lower segments 206A and 206B. Either of the upper segment 206A and the lower segment 206B can be connected with the upright segment 206C via a curved joint. The upper segment 206A can be pivotally connected with the upper end of the first frame portion 210 about a pivot axis perpendicular to the ground. Moreover, a space between the upper and lower segments 206A and 206B can be adapted to accommodate the placement of the seat assembly 204.

The seat assembly 204 can include a front tube element 214, a rear tube element 215 connected with the front tube element 214, two seat coupling elements 216, and a linkage 217. Left and right side segments of the front tube element 214 and the rear tube element 215 can be respectively connected with the two seat coupling elements 216. The linkage 217 can be assembled below the front tube element 214 and the rear tube element 215, and have left and right side distal ends respectively affixed with the two seat coupling elements 216. A central portion of the linkage 217 can be affixed with the lower segment 206B of the swing arm 206. The seat assembly 204 can be thereby held by the swing arm 206 between the upper end of the first frame portion 210 and the base 212B, and can perform swing motion driven by the swing arm 206.

Figure 11:
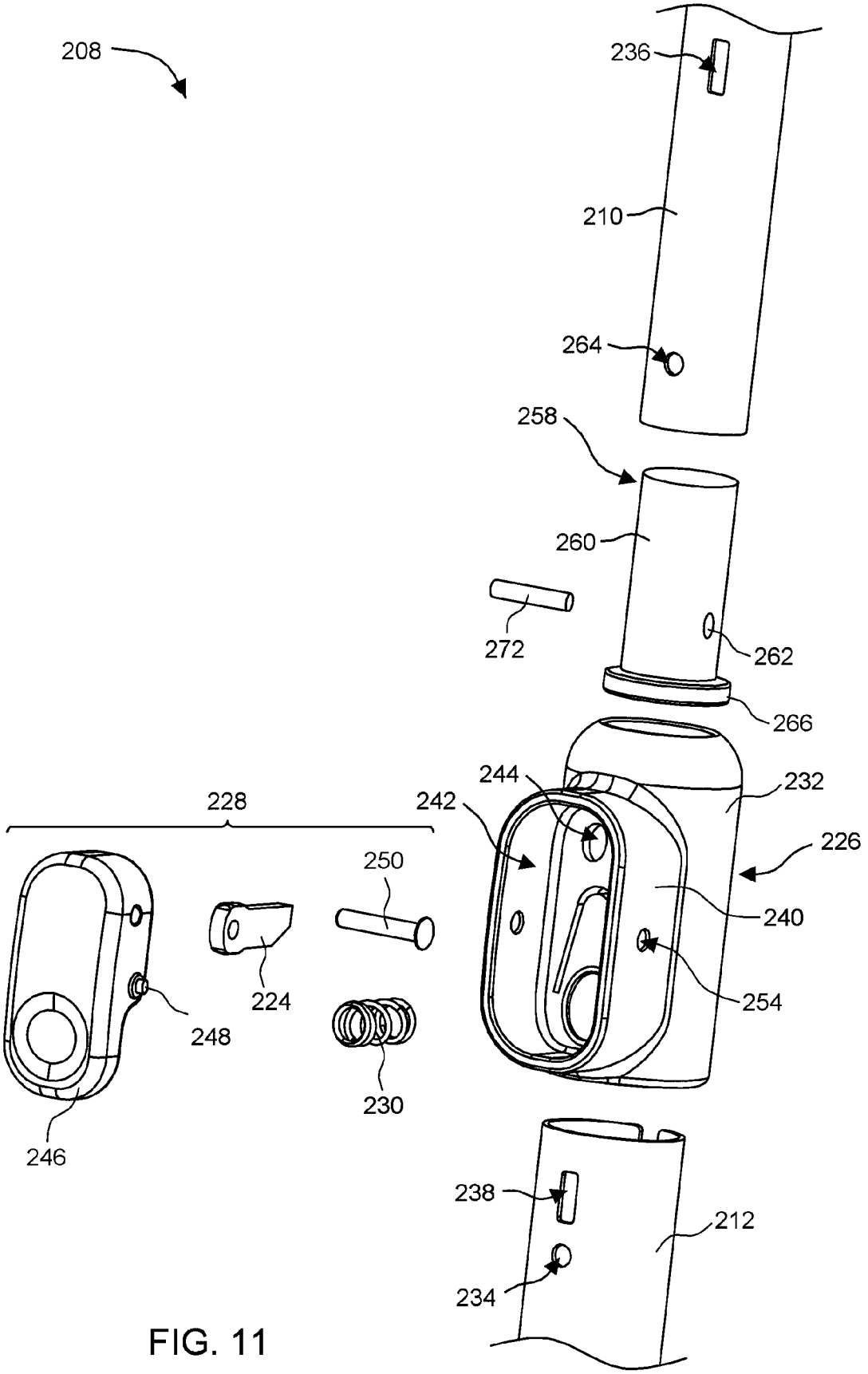
FIG. 11 is an exploded view illustrating the height adjustment mechanism shown in FIG. 10.
Figure 12:
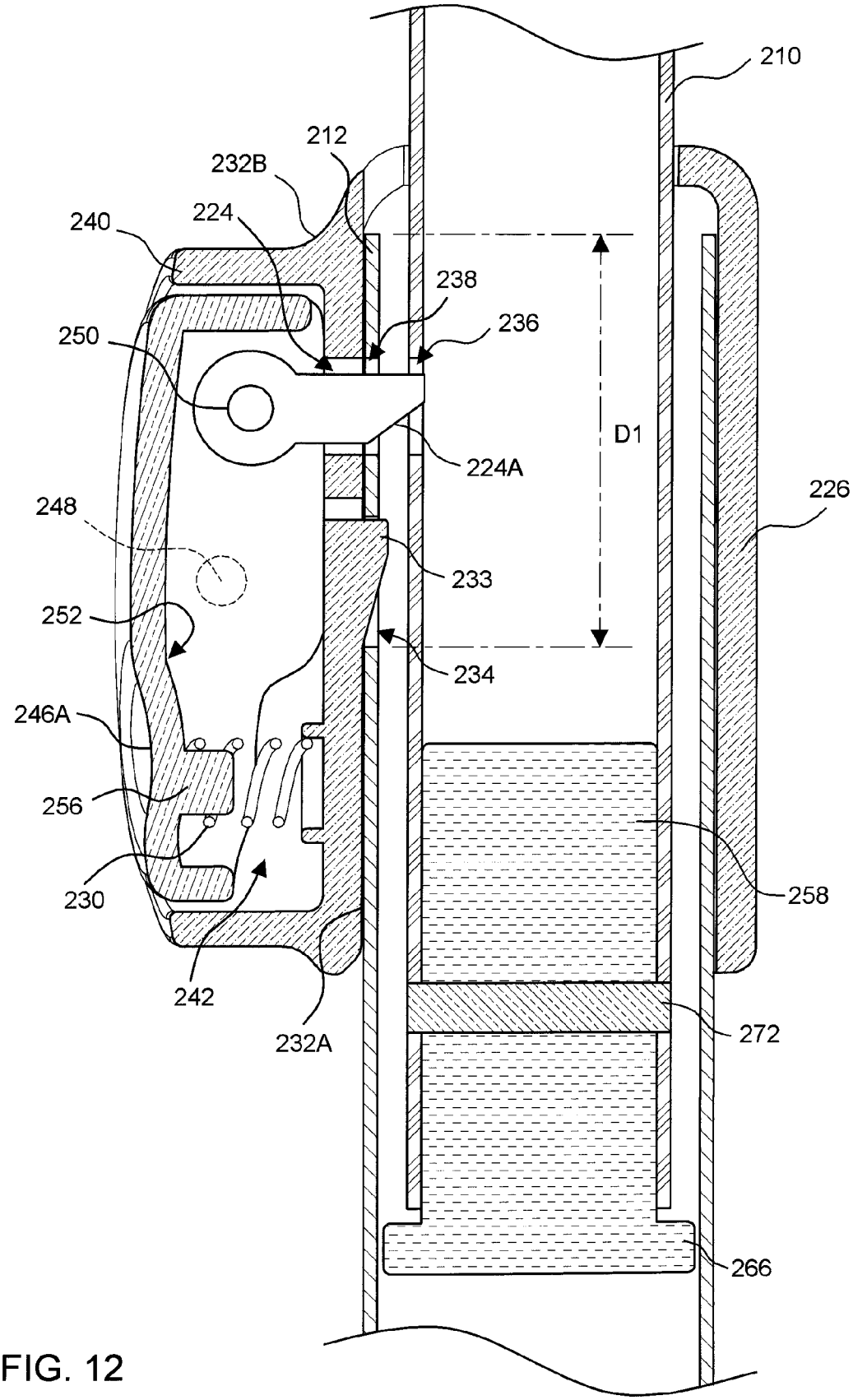
FIG. 12 is a schematic cross-sectional view illustrating the height adjustment mechanism of FIG. 11.

FIG. 11 is an exploded view illustrating the height adjustment mechanism 208, and FIG. 12 is a schematic cross-sectional view illustrating the height adjustment mechanism 208. As shown in FIGS. 11 and 12, each of the height adjustment mechanisms 208 can include a latch element 224, a housing 226, a release button 228 and a spring 230. The housing 226 can include a sleeve 232 having an inner sidewall 232A provided with a protrusion 233. The sleeve 232 can also have an outer sidewall 232B provided with a raised portion 240. The raised portion 240 can have a pocket 242 in which is received the release button 228. The housing 226 can further include an aperture 244 that can extend from a bottom of the pocket 242 to the inner sidewall 232A.

The second frame portion 212 can have a hole 234, and a hole 238 located above the hole 234. The protrusion 233 can be fixedly engaged with the 234 to affix the housing 226 with an outer surface of the second frame portion 212. After the housing 226 is affixed with the second frame portion 212, the hole 238 of the second frame portion 212 can be aligned with the aperture 244 of the housing 226.

The release button 228 can include a button body 246, two pivot pins 248 symmetrically protruding outward from two sides of the button body 246, and a rivet 250. The button body 246 can include a cavity 252. An end portion of the latch element 224 can be affixed with an inner sidewall of the cavity 252 via the rivet 250 at a position vertically higher than the positions of the pivot pins 248. The pivot pins 248 can be mounted through openings 254 provided on inner sidewalls of the pocket 242 so as to pivotally connect the release button 228 provided with the latch element 224 with the housing 226. Once the release button 228 is mounted in place, the latch element 224 can pass through the aperture 244 of the housing 226. Moreover, an inner sidewall of the cavity 252 can also include an anchor rib 256, the pivot pins 248 being located between the anchor rib 256 and the latch element 224. The spring 230 can have a first end connected with the anchor rib 256, and a second end connected with an opposite inner sidewall of the pocket 242.

Referring again to FIGS. 11 and 12, the first frame portion 210 can also include a plurality of locking positions, e.g., a first locking position 236, and a second locking position 237 higher than the first locking position 236. The first and second locking positions 236 and 237 can be formed as openings, holes, or like structures. In the illustrated embodiment, the first locking position 236 can be exemplary a hole, and the second locking position 237 can be exemplary an elongated blind slot. When the first frame portion 210 is pulled upward, which causes the second locking position 237 to become visible from the outside, the blind slot of the second locking position 237 can prevent undesirable pinching. In addition, the lower end of the first frame portion 210 can be affixed with a plunger 258. The plunger 258 can include a generally cylindrical sleeve body 260 having an outer surface provided with a pair of holes 262. A lower end of the plunger 258 can include an annular flange 266 protruding outward. After the sleeve body 260 is inserted through the lower end of the first frame portion 210, a fastener element 272 can be engaged through a hole 264 of the first frame portion 210 and the holes 262 of the sleeve body 260 to fasten the sleeve body 260 with the first frame portion 210. Once the sleeve body 260 is assembled with the first frame portion 210, the flange 266 is located outside the first frame portion 210.

The first frame portion 210 provided with the sleeve body 260 can be assembled through the interior of the second frame portion 212 and the housing 226, and can be movable up and down relative to the second frame portion 212 and the housing 226 to adjust the height of the support frame 202.

As shown in FIG. 12, when the height adjustment mechanism 208 is in a locked state, the latch element 224 can extend through the hole 238 of the second frame portion 212 and engage with one locking position (e.g., the first locking position 236) of the first frame portion 210. The first frame portion 210 can be thereby locked with the second frame portion 212.

Figure 13:
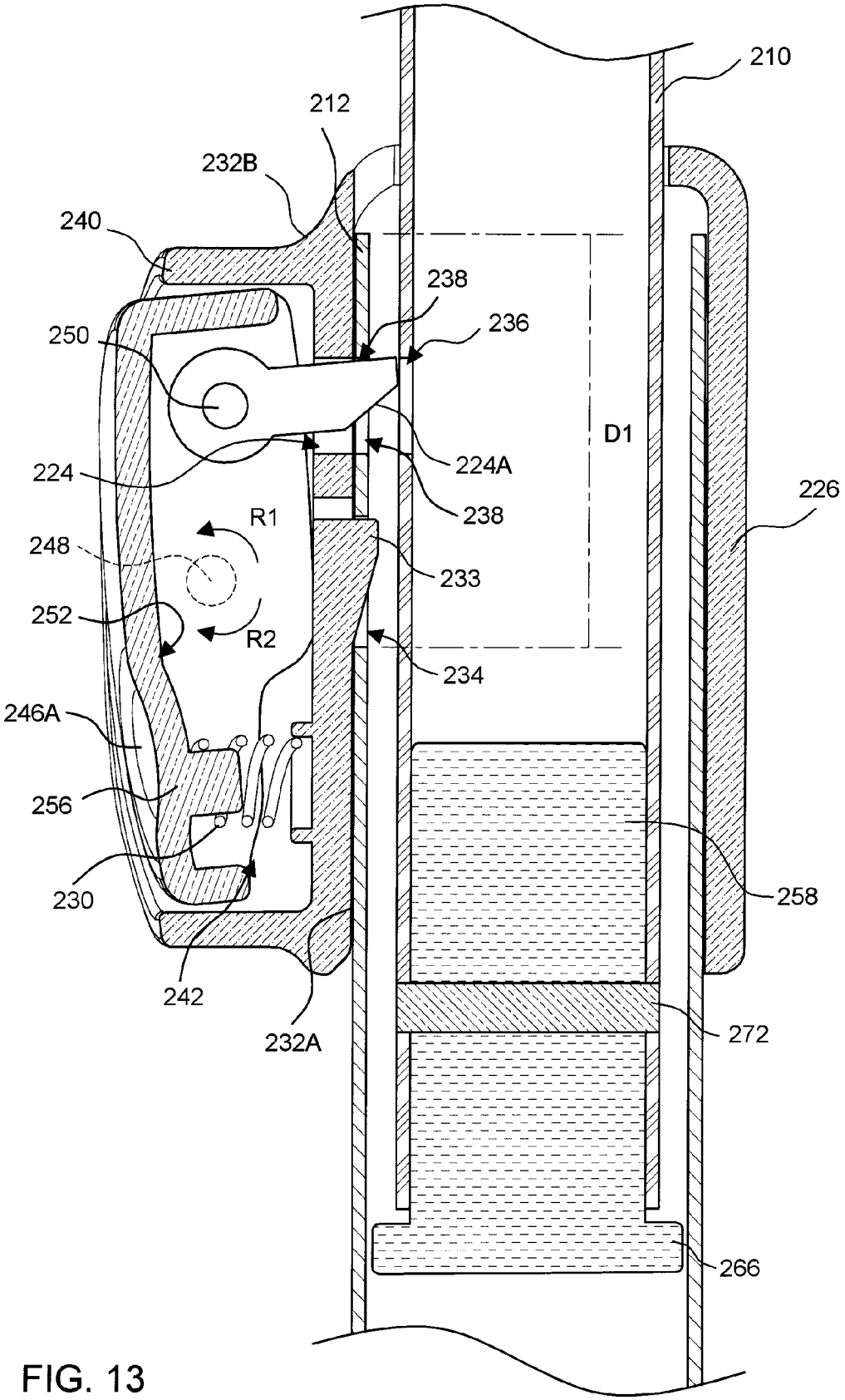
FIG. 13 is a schematic view illustrating the height adjustment mechanism of FIG. 11 in an unlocked state.

FIG. 13 is a schematic view illustrating the height adjustment mechanism 208 in an unlocked state. When the height adjustment mechanism 208 is to be switched from the locked state to the unlocked state, a pressure area 246A of the button body 246 can be depressed so as to drive the release button 228 to rotate in the direction R1 relative to the housing 226. As the release button 228 is rotating in the direction R1, the spring 230 is compressed, and the latch element 224 can be driven to disengage from the first locking position 236 of the first frame portion 210, which can remove the locking engagement between the first frame portion 210 and the second frame portion 212. The first frame portion 210 then can be driven to slide linearly relative to the second frame portion 212 to adjust the length of the first frame portion 210 lying in the second frame portion 212. When the first frame portion 210 is adjusted to increase the length of the first frame portion 210 lying in the second frame portion 212, the overall height of the support frame 202 can be reduced to lower the seat assembly 204 relative to the ground.

It is worth noting that a lower edge of the latch element 224 can form an angled surface 224A. As the first frame portion 210 is moving upward, the first locking position 236 (e.g., a hole) can have an edge that comes in contact with the angled surface 224A so as to push the latch element 224 toward the second frame portion 212. As a result, the latch element 224 can be disposed outside the first frame portion 210. Accordingly, the upward movement of the first frame portion 210 can automatically remove the locking engagement between the first frame portion 210 and the second frame portion 212, without the need of actuating the release button 228. The height adjustment mechanism 208 can further include a structure adapted to prevent entire separation of the first frame portion 210 from the second frame portion 212. When the length of the first frame portion 210 lying in the second frame portion 212 reaches the shortest affordable length, the flange 266 of the plunger 258 can abut against the protrusion 233 of the housing 226 to block further upward movement of the first frame portion 210. The upward movement of the first frame portion 210 can be therefore limited to prevent complete separation of the first frame portion 210 from the second frame portion 212.

Figure 14:
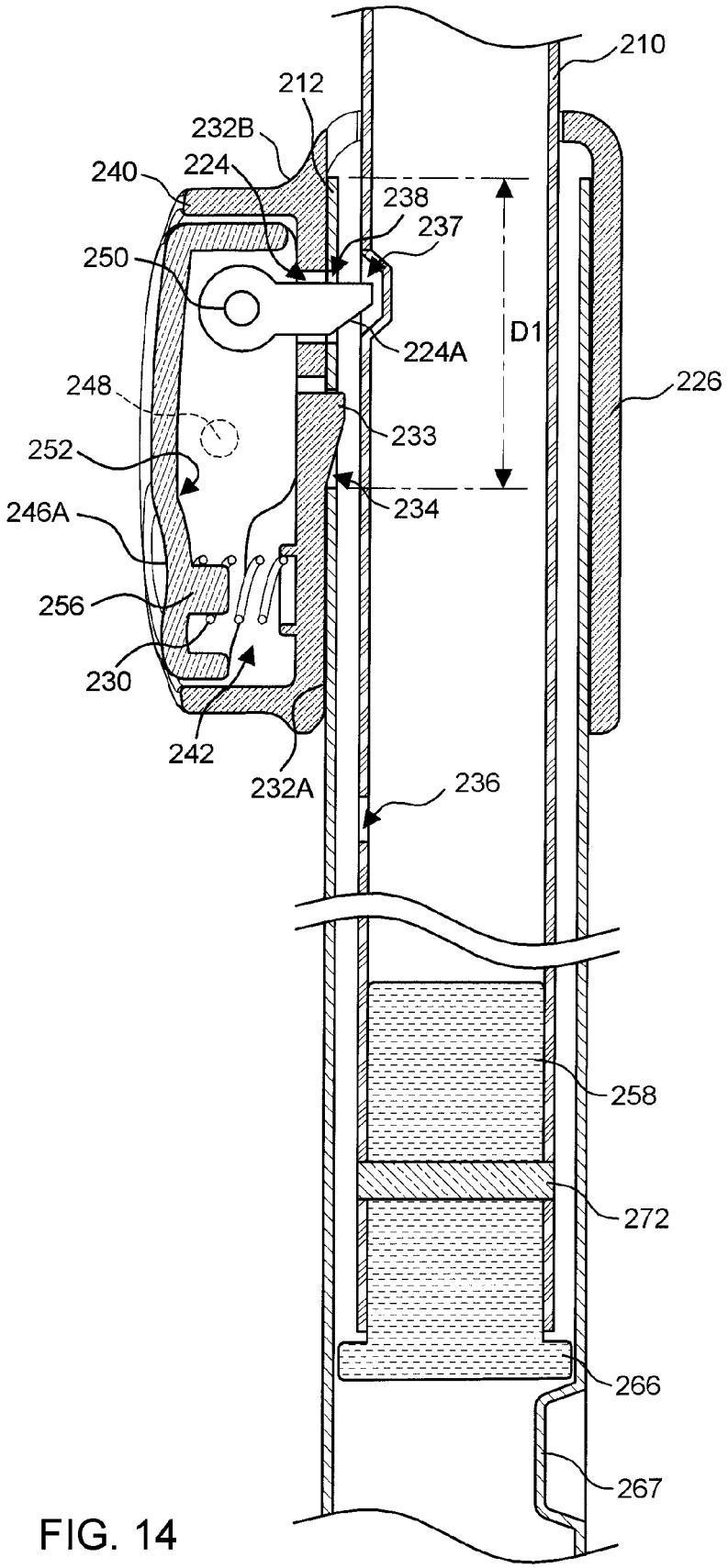
FIG. 14 is a schematic cross-sectional view illustrating the height adjustment mechanism of FIG. 11 after the support frame is reduced in height.

FIG. 14 is a schematic cross-sectional view illustrating the height adjustment mechanism 208 after the support frame 202 is reduced in height. Once the support frame 202 is adjusted to the desired height, the release button 228 can be released. As a result, the spring 230 can urge the release button 228 to rotate in the direction R2 so that the latch element 224 can engage with the second locking position 237 (e.g., formed by a blind slot having an angled edge surface) of the first frame portion 210, whereby the first frame portion 210 can be locked with the second frame portion 212. In addition, the second frame portion 212 can also include a stop element 267. When the first frame portion 210 is lowered a certain distance, the flange 266 can abut against the stop element 267 to block further downward movement of the first frame portion 210, whereby the movement of the first frame portion 210 can be downwardly limited.

With the above construction of the support frame 202 and height adjustment mechanism 208, at least two configurations can be desirably selected according to the use needs. Moreover, the height adjustment can be conveniently operated with a one single operation.

Figure 15:
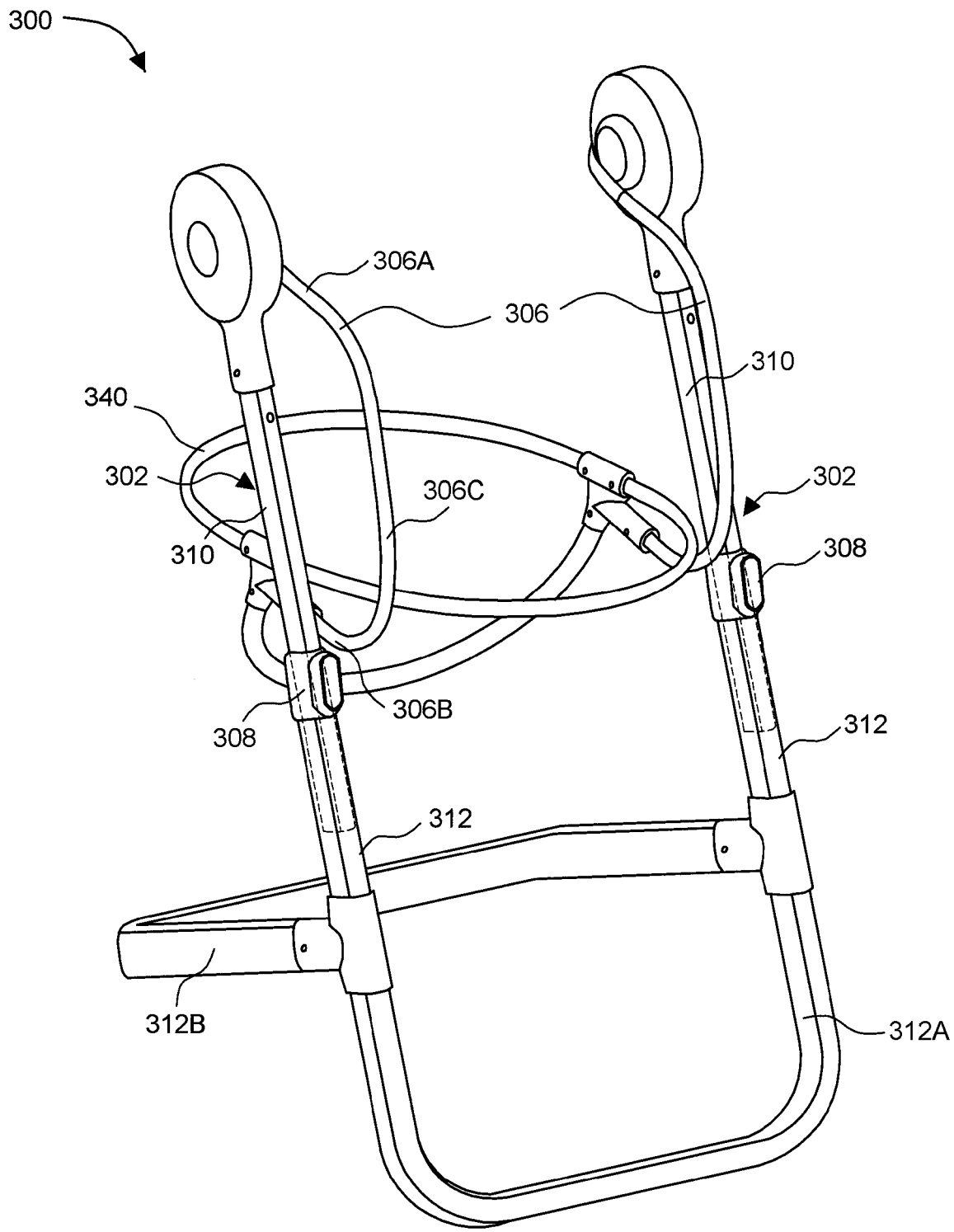
FIG. 15 is a schematic view illustrating a third embodiment of an infant carrier apparatus.
Figure 16:
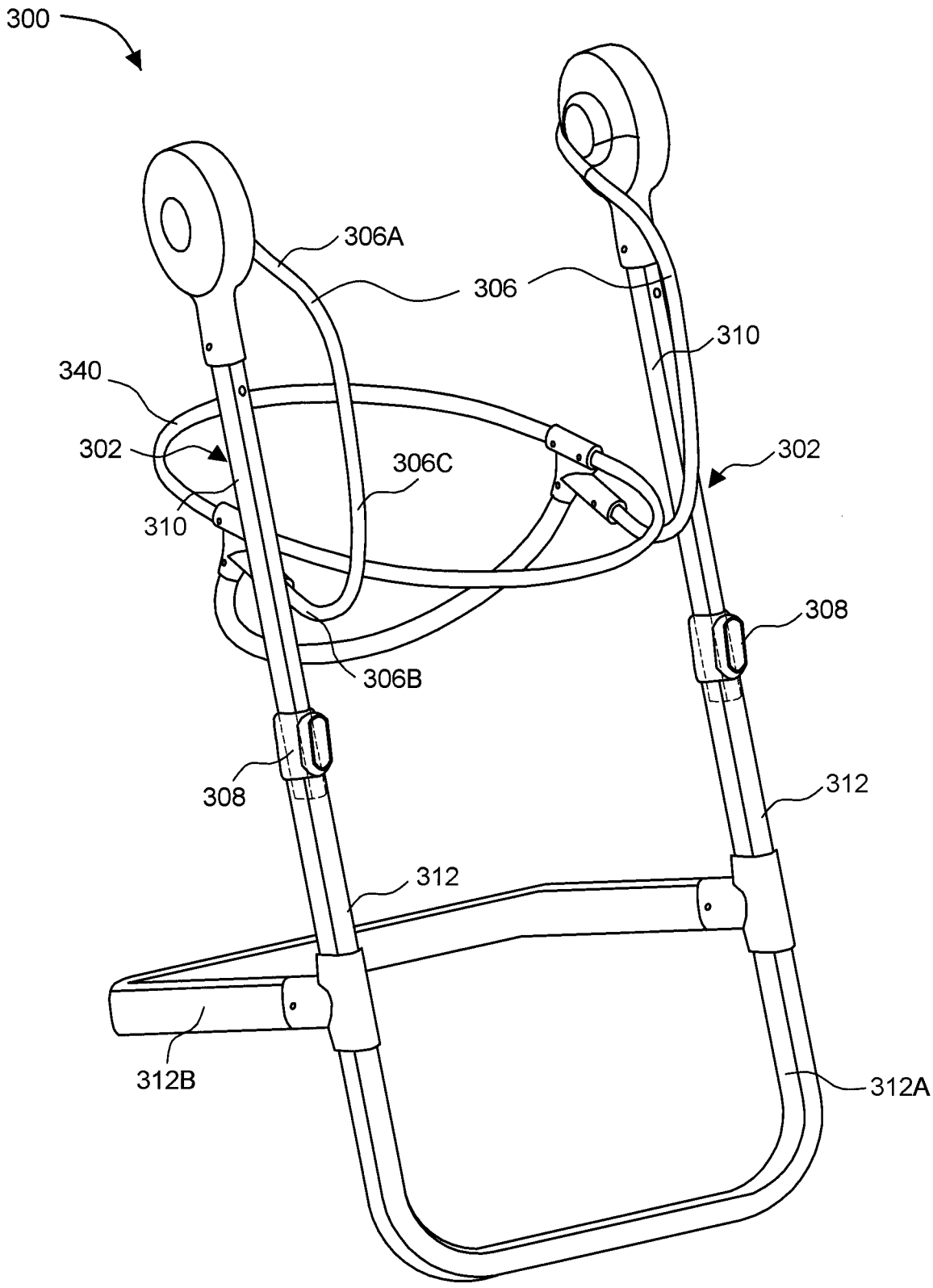
FIG. 16 is a schematic view illustrating the third embodiment of the infant carrier apparatus after height adjustment.

FIG. 15 is a schematic view illustrating another infant carrier apparatus 300, and FIG. 16 is a schematic view illustrating the infant carrier apparatus 300 after height adjustment. As shown in FIGS. 15 and 16, the infant carrier apparatus 300 can include a support frame 302, a seat assembly 304 and a pair of swing arms 306. The support frame 302 can include a pair of first frame portions 310, and a second frame portion 312. The first frame portions 310, the second frame portion 312 and the swing arms 306 can have a design differing from the previous embodiments. The second frame portion 312 can include a first support leg 312A, and a second support leg 312B assembled with the first support leg 312A. Each of the first and second support legs 312A and 312B can have a generally U-shape with side segments extending upward, and adapted to provide stable standing on the ground. The location where the second support leg 312B is connected with the first support leg 312A can be desirably adjusted. The upper ends 306A of the swing arms 306 can be respectively connected pivotally with upper ends of the first frame portions 310 about pivot axes that are generally parallel to the ground. The first frame portions 310 can be respectively connected with the second frame portion 312 via height adjustment mechanisms 308, which can be operable to adjust the overall height of the support frame 302 as well as the height of the seat assembly 304 relative to the ground in the same manner as described previously. Moreover, the seat assembly 304 can be mounted with the support frame 302 via the swing arms 306.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. An infant carrier apparatus comprising:

a support frame having a generally L-shape, the support frame including a first frame portion and a second frame portion, the first frame portion having a portion inserted into the second frame portion;

a swing arm including an upper segment, a lower segment parallel to the upper segment, and an upright segment connected between the upper segment and the lower segment, wherein the upper segment is pivotally connected with an upper end of the support frame;

a seat assembly disposed in a region between the upper segment and the lower segment, wherein the seat assembly is connected with the lower segment of the swing arm; and a height adjustment mechanism including:

a latch element;

a release button affixed with the latch element, the release button being pivotally assembled with the second frame portion, the latch element being in locking engagement with the first and second frame portions in a locked state of the height adjustment mechanism, and the release button being operable to cause the latch element to disengage from the first frame portion for switching the height adjustment mechanism to an unlocked state and allowing the first frame portion to linearly move relative to the second frame portion;

a housing affixed with the second frame portion and receiving the first frame portion passing there through, the release button being pivotally connected with the housing; and a spring having a first end connected with the housing, and a second end connected with the release button;

wherein the release button is operable to rotate relative to the housing to compress the spring and drive the latch element in movement for switching the height adjustment from the locked state to the unlocked state.

2. The infant carrier apparatus according to claim 1, wherein at least one of the upper segment and the lower segment of the swing arm is connected with the upright segment via a curved joining portion.

3. The infant carrier apparatus according to claim 1, wherein the housing includes a sleeve having an inner sidewall provided with a protrusion, and the second frame portion has a first hole through which the protrusion is fixedly engaged.

4. The infant carrier apparatus according to claim 3, wherein the sleeve has an outer sidewall provided with a raised portion, the raised portion having a pocket in which the release button is pivotally assembled.

5. The infant carrier apparatus according to claim 4, wherein the housing further includes an aperture that extends from an inner side of the pocket to the inner sidewall of the sleeve, and the latch element is mounted to pass through the aperture.

6. The infant carrier apparatus according to claim 4, wherein the release button includes a button body having a cavity, two pivot pins protruding outward from two sides of the button body, and the raised portion includes a pair of openings to which the pivot pins are pivotally connected.

7. The infant carrier apparatus according to claim 6, wherein the release button includes a rivet that fastens an end portion of the latch element with an inner sidewall of the cavity, the second end of the spring being connected with an inner side of the cavity.

8. The infant carrier apparatus according to claim 4, wherein the pocket includes an anchor rib to which the first end of the spring is connected.

9. The infant carrier apparatus according to claim 3, wherein the second frame portion includes a second hole that is located above the first hole and through which the latch element is passed, and the first frame portion includes a plurality of locking positions, the latch element engaging with a first one of the locking positions when the height adjustment mechanism is in the locked state, and disengaging from the first locking position when the height adjustment mechanism is in the unlocked state.

10. The infant carrier apparatus according to claim 9, wherein the latch element has a lower edge forming an angled surface, the first locking position coming in contact with the angled surface as the first frame portion moves upward so as to push the latch element toward the second frame portion and out of the first frame portion.

11. The infant carrier apparatus according to claim 9, wherein the locking positions are holes or elongated blind slots.

12. The infant carrier apparatus according to claim 3, wherein an end of the first frame portion is affixed with a plunger that is mounted through an interior of the first frame portion, the plunger including a sleeve body having an outer surface provided with an annular flange protruding outward, the annular flange protruding outside the first frame portion and being located inside the second frame portion.

13. The infant carrier apparatus according to claim 12, wherein the outer surface of the sleeve body is provided with a snap stud, and the first frame portion includes a catch hole through which the snap stud engages to affix the plunger with the first frame portion.

14. The infant carrier apparatus according to claim 12, wherein the annular flange abuts against the protrusion of the housing when a portion of the first frame portion inserted into the second frame portion reaches a predetermined length.

15. The infant carrier apparatus according to claim 12, wherein an inner side of the second frame portion includes a stop element, when the first frame portion is lowered a predetermined distance, the annular flange abuts against the stop element to block further downward movement of the first frame portion.

16. The infant carrier apparatus according to claim 1, wherein the upper segment of the swing arm is pivotally connected with an upper end of the first frame portion, a lower end of the first frame portion is connected with the height adjustment mechanism, and the second frame portion includes a base having a generally U-shape for providing stable support, and an upright segment connected between the base and the height adjustment mechanism, the seat assembly being held between the upper end of the first frame portion and the base.

17. The infant carrier apparatus according to claim 16, wherein the upper segment of the swing arm is pivotally connected with the upper end of the first frame portion about a pivot axis that is substantially perpendicular to a ground.

18. The infant carrier apparatus according to claim 1, wherein the second frame portion includes a first support leg, and a second support leg assembled with the first support leg, each of the first and second support legs having a generally U-shape with side segments extending upward and adapted to provide stable standing on a ground, a location where the second support leg is connected with the first support leg being adjustable.

19. The infant carrier apparatus according to claim 18, wherein the upper segment of the swing arm is pivotally connected with the upper end of the first frame portion about a pivot axis that is substantially parallel to a ground.

20. The infant carrier apparatus according to claim 1, being an infant swing apparatus.

21. An infant carrier apparatus comprising:

a support frame including a first and a second frame portion, the second frame portion having a base for providing stable support and an upright segment connected with the base, and the first frame portion having a portion assembled with the upright segment;

a height adjustment mechanism assembled with the upright segment and operable to adjust an extension of the first frame portion relative to the second frame portion;

a swing arm including an upper segment, a lower segment vertically spaced apart from the upper segment, and an intermediate segment connected between the upper segment and the lower segment, wherein the upper segment is pivotally connected with an upper end portion of the first frame portion about a pivot axis that extends substantially vertical and is spaced apart from the upright segment; and a seat assembly disposed in a region between the upper segment and the lower segment of the swing arm, wherein the seat assembly is connected with the lower segment of the swing arm.

22. The infant carrier apparatus according to claim 21, wherein the height adjustment includes:

a latch element;

a release button affixed with the latch element, the release button being pivotally assembled with the second frame portion, the latch element being in locking engagement with the first and second frame portions in a locked state of the height adjustment mechanism, and the release button being operable to cause the latch element to disengage from the first frame portion for switching the height adjustment mechanism to an unlocked state and allowing the first frame portion to linearly move relative to the second frame portion;

a housing affixed with the upright segment of the second frame portion and receiving the first frame portion passing there through, the release button being pivotally connected with the housing; and a spring having a first end connected with the housing, and a second end connected with the release button;

wherein the release button is operable to rotate relative to the housing to compress the spring and drive the latch element in movement for switching the height adjustment from the locked state to the unlocked state.

23. The infant carrier apparatus according to claim 21, wherein the first frame portion includes a bent portion that terminates into the upper end portion where the upper segment of the swing arm is pivotally connected.

* * * * *